US005467677A

United States Patent [19]

Kinson, Jr.

[11] Patent Number: 5,467,677

[45] Date of Patent: Nov. 21, 1995

[54] CUTTING APPARATUS

[75] Inventor: Robert D. Kinson, Jr., Sidney, Ohio

[73] Assignee: Baumfolder Corporation, Sidney, Ohio

[21] Appl. No.: 92,641

[22] Filed: Jul. 16, 1993

[30] Foreign Application Priority Data

Jul. 17, 1992 [DE] Germany ..... 9209633 U

[51] Int. Cl.[6] ..... B26D 5/20

[52] U.S. Cl. ..... 83/155; 83/934; 83/468.6; 83/452; 271/198; 271/199; 412/16; 412/32

[58] Field of Search ..... 83/155, 934, 468.6, 83/436, 155.1, 452; 271/272, 198, 199, 245, 246; 198/626.5, 626.6, 604; 412/16, 32

[56] References Cited

U.S. PATENT DOCUMENTS

| | | | |
|---|---|---|---|
| 3,321,202 | 5/1967 | Martin | 271/199 |
| 3,601,265 | 11/1968 | Shields | 271/198 |
| 3,662,635 | 5/1972 | Yabuta | 83/468.6 |
| 3,728,921 | 4/1973 | Vogel | 83/452 |
| 3,815,897 | 6/1974 | Hoehl et al. | 271/272 |
| 3,923,169 | 12/1975 | Van Drie | 198/604 |
| 4,480,516 | 11/1984 | Leroy | 83/436 |
| 5,035,164 | 7/1991 | Cremona | 83/155.1 |
| 5,086,681 | 2/1992 | Ruetschle et al. | 83/934 |
| 5,147,092 | 9/1992 | Driscoll et al. | 271/245 |
| 5,228,373 | 9/1993 | Welsch | 83/155 |
| 5,322,269 | 6/1994 | Fukube et al. | 271/272 |

OTHER PUBLICATIONS

Brochure for the Stahl Saddle Stitcher ST. 100 dated May 3, 1993.

*Primary Examiner*—Richard K. Seidel
*Assistant Examiner*—Allan M. Schrock
*Attorney, Agent, or Firm*—Millen, White, Zelano & Branigan

[57] ABSTRACT

Apparatus for trimming small booklet-like products transported by bands (16) between a position serving for front trimming and a position serving for foot and head trimming. The bands (16) include a pair of transport bands (18,20) guided about a respective main deflecting roll (24) at their ends facing an insertion region (22). A synchronously-drivable auxiliary transport band (26) extends beyond the main transport bands (18,20) toward the insertion region (22) and is guided about an auxiliary deflection roll (28) at its end facing the insertion region (22). The diameter (d) of the auxiliary roll (28) is less than ⅓ the diameter (D) of the main deflection roll (24).

32 Claims, 6 Drawing Sheets

CUTTING APPARATUS

BACKGROUND OF THE INVENTION

1. Introduction

The present application corresponds to German Application G 92 09 633 6, entitled "Cutting Apparatus" filed on my behalf on Jul. 17, 1992. That application is incorporated herein by reference in its entirety.

The present invention relates to an apparatus for trimming products bound in a booklet-like manner for insertion into a cutting apparatus, bound spine ahead, for transport onwards between a first position serving for front trimming and a second position serving for foot and head trimming. The transport means includes at least one pair of transport bands which are guided about a relatively small deflection roll at their ends facing the insertion region.

2. Description of the Prior Art

Such a cutting device, which is also known as a knife trimmer, is for instance used in a gather-stitcher system where it usually immediately follows a stitching station. The products, which have already been stitched, are inserted into the cutting machine via chain drivers, for instance, where they first occupy a first position serving for front trimming and are subsequently transported onwards to a second position where foot and head trimming is carried out.

In the previous cutting machines of this type, the relatively massive design of the transport means impeded the use of formats having a smaller base length as measured perpendicularly with respect to the spine and obtained via the front trimming. The knife or hold-down means associated with such devices cannot be disposed in any vicinity to the clamping location constituted by the pair of transport bands. This is because the deflection rolls are too large and the penetration depth is too low. There is also a risk for the product inserted up to the position serving for front trimming in that the required further transport is no longer ensured or that good registry is no longer provided for during such transport operation.

It is the object of the present invention to provide an apparatus of the type specified above for also realizing formats having smaller base lengths, in particular, and for making sure that the further transport of the product concerned for subsequent foot and head trimming is effected without warping occurring.

SUMMARY OF THE INVENTION

In accordance with the invention, a generic apparatus of the type specified has at least one synchronously drivable, auxiliary-transport band associated with at least one of two transport bands of a respective pair of transport bands. The auxiliary transport band extends beyond the main transport band concerned towards the insertion region and is guided about an auxiliary deflection roll at its end facing the insertion region, wherein the diameter of the auxiliary deflection roll is less than the diameter of the deflection roll of the main transport band.

Due to this configuration, substantially shorter base lengths may be transported. It is also ensured that the product be transported onwards, after the front trimming has been carried out, into a second position serving for foot and head trimming without any warping and in good registry. Such further transport is guaranteed even if the product does not enter a clamping gap formed by the main transport band and an opposite transport band. It is sufficient that the product is gripped by the auxiliary transport band extending toward the insertion region. Due to the relatively small diameter of the deflection roll for the auxiliary transport band, the spacing between the knife serving for front trimming or a hold-down means associated therewith, respectively, and the adjacent location of engagement between the auxiliary transport band and the product concerned may be kept small. Even if the product is simultaneously gripped by both bands, warp-free transport is ensured due to the main transport band and the auxiliary transport band being driven simultaneously.

More particularly, the diameter of the deflection roll of the auxiliary transport band may be less than half, preferably less than a third of the diameter of the deflection roll of the main transport band.

DESCRIPTION OF THE DRAWINGS

In the following, the invention will be explained in detail with reference to the drawings; wherein.

DESCRIPTION OF PREFERRED EMBODIMENTS

Figure 1:
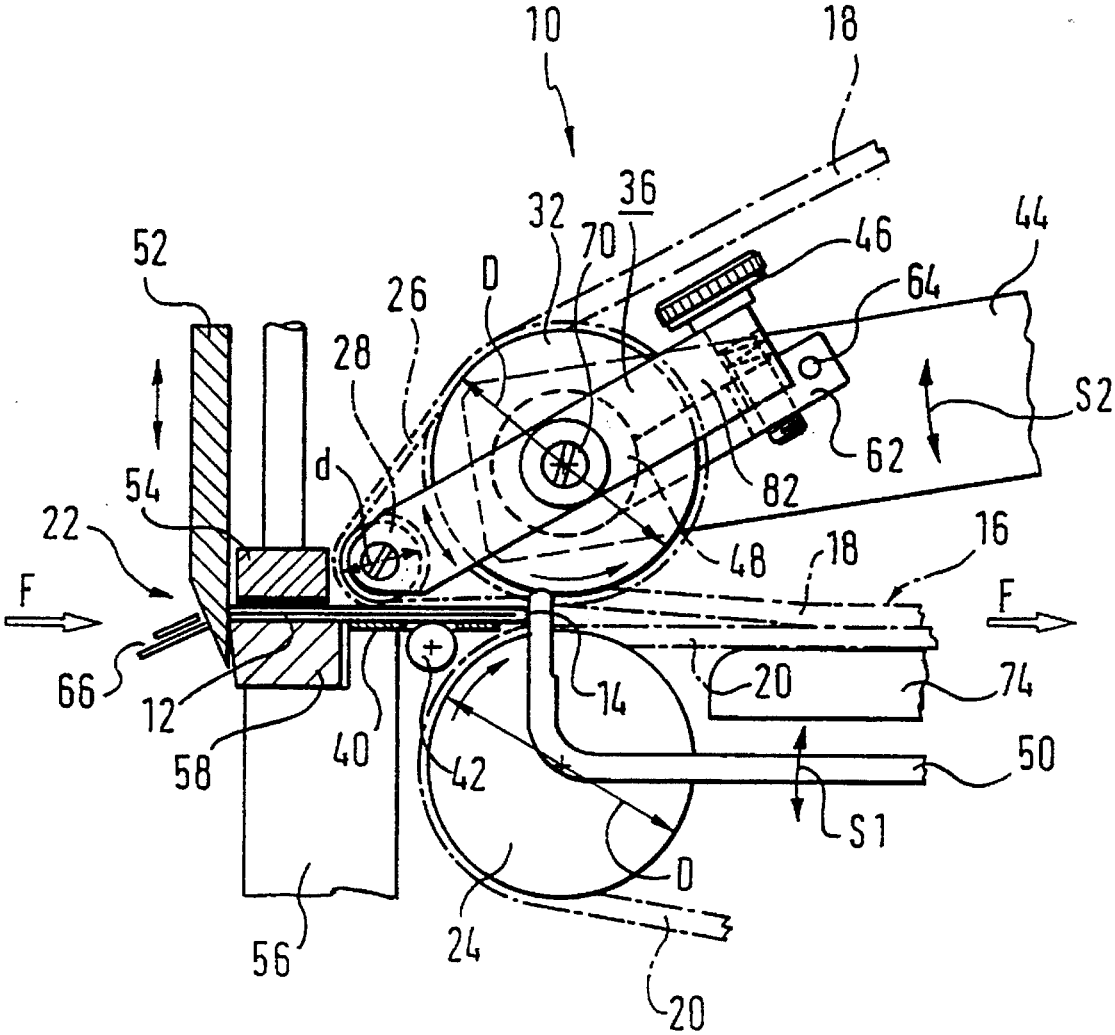
FIG. 1 is a schematic sectional representation of an apparatus for trimming products bound in a booklet-like manner along line I—I of FIG. 2.
Figure 2:
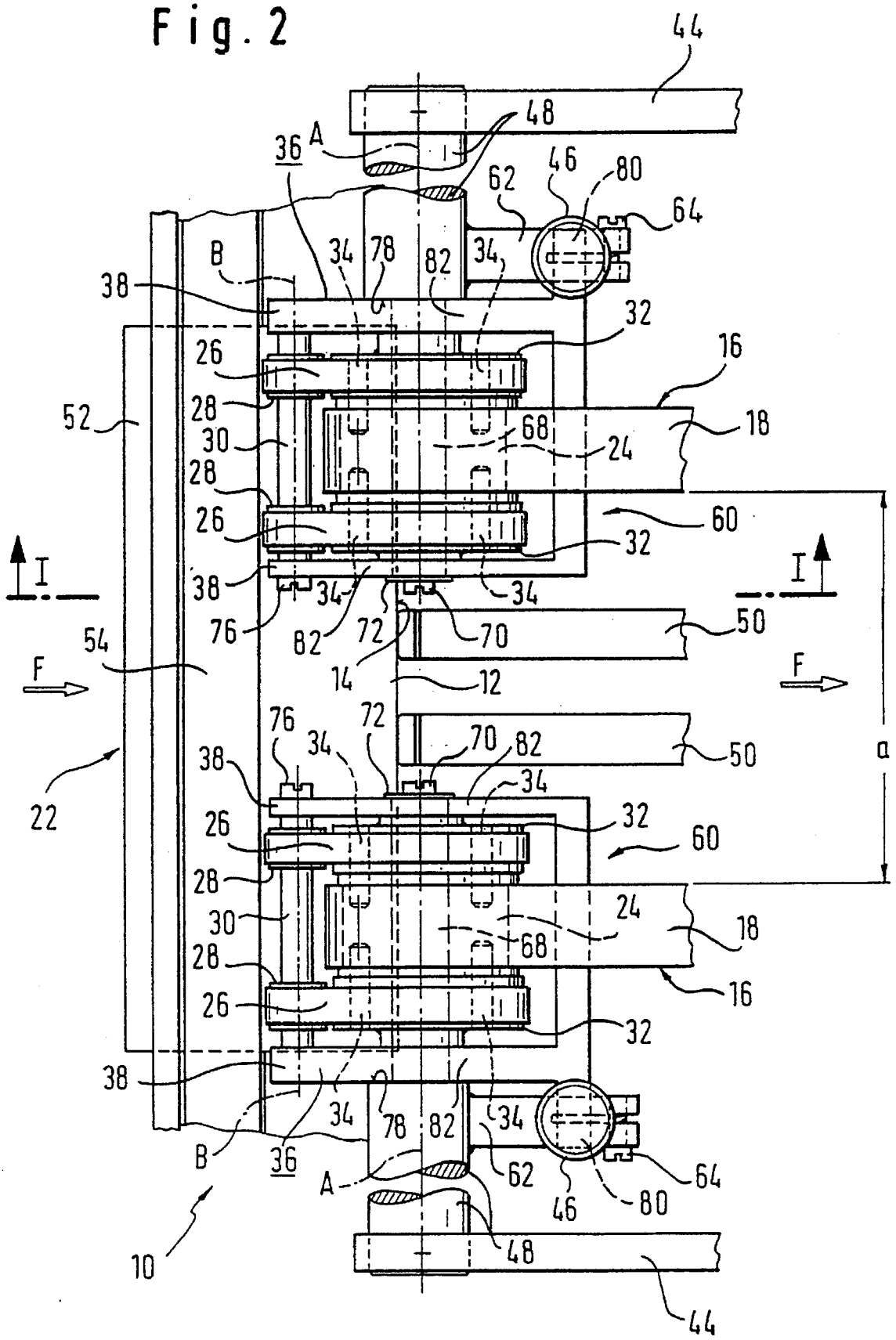
FIG. 2 is a schematic plan view of the cutting apparatus according to FIG. 1.

FIGS. 1 and 2 show an apparatus 10 for trimming products 12 bound in a booklet-like manner in a purely schematic representation wherein respective products 12 are insertable in the direction of arrow F, bound spine 14 ahead.

Cutting apparatus 10 is provided with a transport means 16 including two pairs of transport bands 18, 20 being formed identically and comprising a spacing "a" from each other, transversely with respect to the direction of transport F. The two transport bands 18, 20 of a respective pair of transport bands are disposed on top of each other and respectively guided about a deflection roll 24 at the end facing insertion region 22.

A soft, padded auxiliary transport band 26 of urethane sponge on neoprene is driven at the same speed as a main transport band 18. The band 26 is associated with upper transport band 18 at both sides of a respective pair of transport bands 18, 20. Each of these auxiliary transport bands 26 extends beyond the main transport band 18 toward the insertion region 22.

At the end facing insertion region 22, the respective auxiliary bands 26 are, in their turn, guided about an auxiliary deflection roll 28 having a diameter d that is significantly less than the diameter D of deflection roll 24 of the main transport band 18. The diameter d of auxiliary deflection roll 28 of auxiliary transport band 26 usefully is less than half, preferably less then a third of the diameter D of deflection roll 24 of main transport band 18. In the illustrated embodiment, diameter d is slightly less than a third of diameter D.

The two auxiliary transport bands 26 associated with a respective main transport band 18 are respectively guided, at the end opposite to auxiliary deflection rolls 28, about a drive roll 32, the rotational axis A thereof being coaxial with to the axis of main deflection roll 24 of the main transport band 18 (see FIG. 2).

The drive rolls 32 drive the auxiliary transport bands 26 and are respectively connected to be rotationally fixed with deflection roll 24 of the respective main transport band 18 via a plurality of pins 34 which are parallel to axis "A" so that both auxiliary transport bands 26 respectively are associated with a respective main transport band 18 and are driven via the main transport band 18. A corresponding drive roll for the main transport band 18 is provided at the opposite band end (not represented).

Rolls 32 have the same diameter D as the main deflection roll 24 concerned so that the auxiliary transport bands 26 are driven at the same speed as the corresponding main transport band 18.

Auxiliary deflection rolls 28 of both auxiliary transport bands 26 associated with a respective main transport band 18 are mounted on a pivotable frame 36 the rotational axis "A" of which is parallel to the axis of main deflection roll 24 of the main transport band 18 (see FIG. 2). The frame 36 is formed to be U-shaped. The corresponding auxiliary deflection rolls 28 of the two auxiliary transport bands 26 are secured to frame 36 to be rotatable about a common axis B, constituted by a shaft 30 extending between the two free leg-ends 38 of frame 36. Shaft 30 is configured to be a hollow shaft and anchored to both legs or arms 82 of the U-shaped frame via a screw fastener 76. Auxiliary deflection rolls 28 are rotatably mounted on said shaft 30 and fixed in the axial direction by corresponding means.

Each of the two U-shaped frames 36 respectively rests on an inner section 68 of a stepped stub shaft having a reduced diameter and being connected to the free end of a swivel arm 44 via an outer section 48 which has a larger diameter, on which frames 36 are radially fixed via annular shoulders 78 as well as screws 70 provided with washers 72. Rotational axis "A" of frame 36 as defined by shaft-section 68 which extends in parallel with respect to axis B as well as the frame web and approximately extends through the center of two arms 82 formed by the frame legs. Main delfection rolls 24 or drive rolls 32, respectively, are also rotatably mounted to the same shaft section 68, within the two frame legs.

The two swivel arms 44 are pivotally affixed to shafts 48 at their free ends. Their opposite (non-represented) ends are connected to a through-type swivel shaft mounted on the stand of cutting apparatus 10.

Respective frames 36 are pivotable about axis A and supported at the web-side ends on knurled screws 46 which serve as stops via lateral projections 80. The screws 46 are screwed into a bracket 62 secured on shaft section 48. The spacing between the deflection rolls 28 of the auxiliary transport bands 26 mounted on frame 36 and a supporting means 40, 42 for inserted product 12 opposite the auxiliary transport bands 26 is set in the clamping position with swivel arms 44 being lowered via the screws 46 (see FIG. 1). The knurled screws 46 may be locked in the bracket 62 by means of screw 64 via which both ends of slotted bracket 62 may be contracted.

In the embodiment represented, supporting means 40, 42 for the respectively inserted product 12 as disposed opposite the auxiliary transport bands 26 includes a supporting plate 40 having a recess for supporting roll 42 provided therein. The supporting means 40, 42 is disposed between main deflection rolls 24 of the pairs of transport bands 18, 20 comprising the same diameter D and a letter including a bottom knife 58 being supported on a bottom knife carrier 56 and having associated therewith an upper punching knife 52 as well as a hold-down means 54 (see FIG. 1).

In the region of knives 58, 52 serving for front trimming, a (non-represented) lower transport means is provided for taking away offcut 66.

Between the two pairs of transport bands 18, 20, there are disposed two stops 50 being upwardly bent to have an L-shape, pivotable in the direction of arrow S1 (see FIG. 1) into the transport path of respective product 12 and abutted by the bound spine 14 of the respective product 12 as soon as the latter occupies its position serving for front trimming as represented in FIGS. 1 and 2. These stops 50 may be adjusted to different formats in the direction of transport.

Through the respective swivel arm 44 pivotable in the direction of arrow $2 (see FIG. 1), the respective frame 36 and, accordingly, the respective end of main transport band 18 as well as auxiliary transport bands 26 associated therewith form a small-format means 60. These, together with frame 36, are pivotable from a position lifted off from opposite transport band 20 or, respectively, supporting means 40, 42 into a clamping position serving for transporting the respective product 12 onwards as represented in FIG. 1. The desired clamping effect between the two transport bands 18, 20 of a respective pair of transport bands is additionally assisted by a leading support 74 associated with the respective lower transport band 20.

Figure 3:
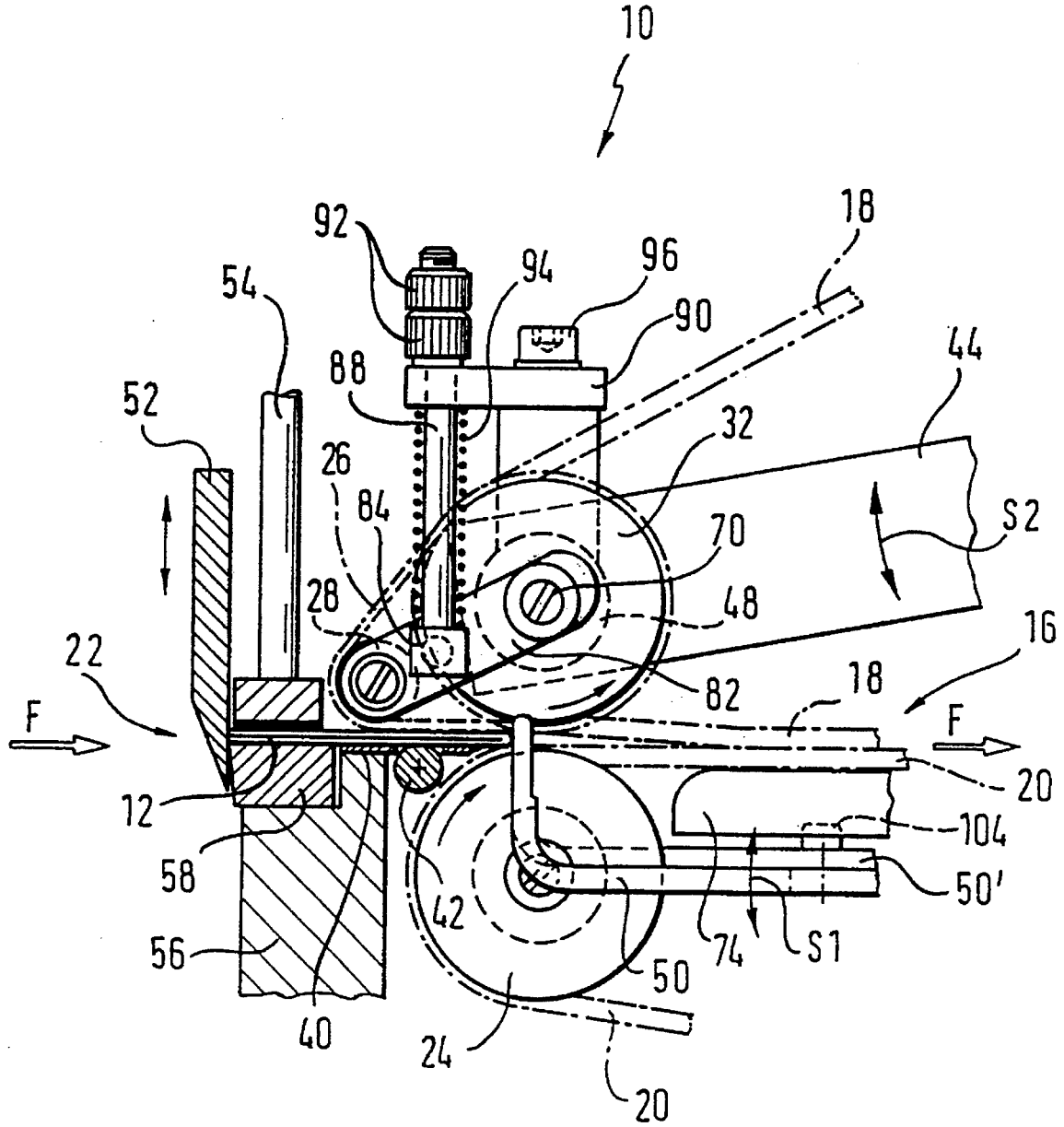
FIG. 3 is a schematic sectional representation of a further modification of the cutting apparatus along line I—I of FIG. 4.
Figure 4:
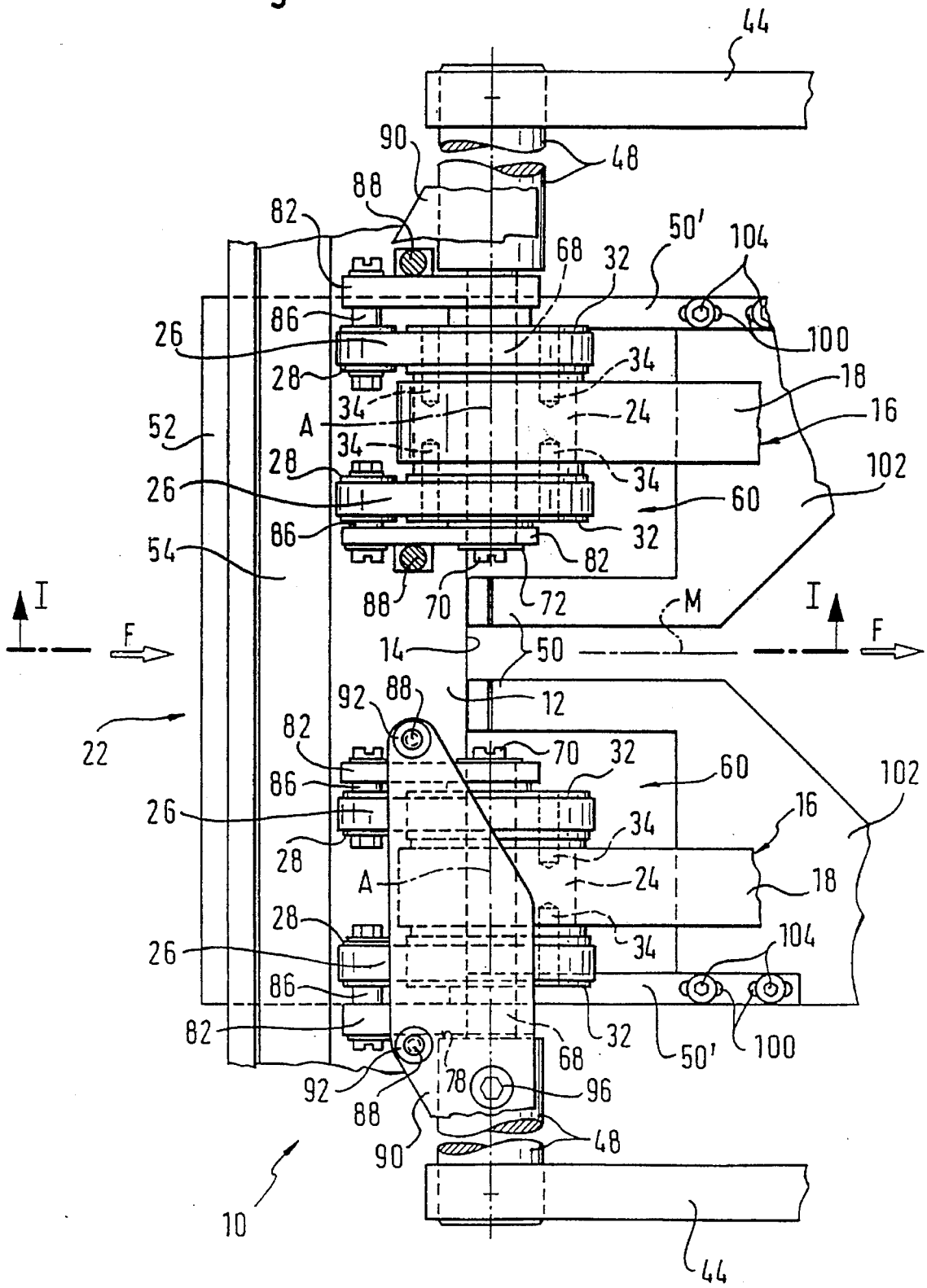
FIG. 4 is a schematic plan view of the cutting apparatus according to FIG. 3.

A further modified embodiment of the cutting apparatus 10 is shown in FIGS. 3 and 4, where the same reference numerals have been used for comparable parts. That embodiment differs from the one according to FIGS. 1 and 2 in that the two auxiliary deflection rolls 28 of a respective pair of auxiliary deflection rolls are no longer disposed on a common frame 36, but on two arms 82 which are pivotable independently of each other. Further, in addition to the two stops 50, two further stops 50' of similar type are provided to be adjustable relative to stops 50.

According to FIGS. 3 and 4, auxiliary deflection rolls 28 of the two auxiliary transport bands 26 associated with a respective main transport band 18 are respectively mounted at one end of a pivotable arm 82. The swivel axis of arm 82 is disposed at the other end and parallel to rotational axis "A" of main deflection roll 24 of the respective main transport band 18. These auxiliary deflection rolls 28 are disposed on the sides of arms 82 facing each other and respectively rest on a stub shaft 86 secured on the respective arm end.

The two arms 82 are pivotable independently of each other and are supported on separate stops 84 which are also adjustable independently of each other. The stops 84 are respectively constituted by a sliding block which is guided in a respective arm 82. One of its ends is connected to a threaded spindle 88 and led through a carrier plate 90 connected with the respective shaft section 48. Two threaded, knurled nuts 92 are provided on each spindle at the end opposite sliding block 84, via which nuts 92 the respective positions of sliding blocks 84 may be adjusted.

In the embodiment represented, spindle 88 is provided with an outer thread at its upper end which receives the two knurled nuts 92. A compression spring 94 is slipped onto each section of threaded spindle 88. Each spring is preferably plain and situated between a carrier plate 90 and a sliding block 84 to press the sliding block 84 and, accordingly, the related arm 82 downwardly until lower knurled nut 92 abuts carrier plate 90.

The two threaded spindles 88 associated with each pair of auxiliary transport bands 26, respectively, are carried by a common carrier plate 90 which is secured to shaft section 48 via a screw 96.

Thus, the two arms 82 respectively are provided with auxiliary deflection rolls 28 which may be adjusted independently of each other via threaded spindles 88. Such separate fine adjustments of the inclination of the two auxiliary transport bands 26 associated with a respective main transport band 18 enables optimum adaptation to various practical conditions such as changes in booklet thickness.

Corresponding adjustment is provided for the further pair of auxiliary transport bands 26. For the sake of simplicity, however, the carrier plate 90 common to the other threaded spindles 88 has been left out here.

Thus, the spacings between auxiliary deflection rolls 28 of the auxiliary transport bands 26 mounted on arms 82 and the opposite supporting means 40, 42 as provided in the clamping position with swivel arms 44 being lowered may be adjusted separately of each other via the threaded spindles 88. On the other hand, all arms 82 respectively carrying a means deflection roll 24 are also moved, together with main deflection rolls 24 of the main transport bands 18, between a release position and a clamping position via the two outer swivel arms 44.

Moreover, each of the two inner stops 50 is upwardly bent to have an L-shape and has associated therewith a further outer stop 50' extending in parallel with the related inner stop 50. The stops are adjustable in the transport direction F via elongated holes 100 (FIG. 4), for instance. The respective inner stop 50 is connected with a web 102 extending in the transverse direction to which the related outer stop 50' is secured via two screws 104 penetrating elongated holes 100 provided at the one end of outer stop 50'. The two stops 50, 50' of a respective pair of stops extend from web 102 like fingers, against the direction of transport F towards insertion region 22 where they are upwardly bent to be at least substantially L-shaped. The two outer stops 50' are narrower as compared with inner stops 50 and are disposed in the region of the respective outer edge of product 12 whereas the two inner stops 50 are provided on both sides of an interposed center line M at a similarly-small spacing less than their width.

Due to the two additional outer stops 50' there accordingly results a four-point abutment for the product, with the two outer stops 50' at least being adjustable relative to inner stops 50. If the respective product 12 comprises staples or the like in the region of outer stops 50' whereas such clips are absent in the region of center stops 50, uniform abutment of the product at the stops may nevertheless be achieved by corresponding fine adjustment of outer stops 50' relative to inner stops 50. The same is true for instance in the case where it is only the inner stops which hit such staples or the like.

The mode of operation of the cutting apparatus in accordance with the invention is as follows:

The respective product 12, which has for instance been bound or stitched by a gather-stitcher, runs, spine ahead, into cutting apparatus 10 to abut on upwardly pivoted stops 50, 50'. During this entry phase, the upper punching knife 52 as well and hold-down means 54 occupy their upper positions. Lower transport bands 20 as well as upper transport bands 18 and, accordingly, associated auxiliary transport bands 26 are stopped. Moreover, swivel arms 44 are pivoted upwardly so that upper bands 18 and 26 are slightly lifted off of lower bands 20 or supporting means 40, 42, respectively, and an entry gap is formed.

Product 12 is then pressed against bottom knife 58 by hold-down means 54 under timed, synchronous operation. The upper transport bands 18 as well as small-format means 60 associated therewith are pivoted downwardly together onto transport bands 20 or supporting means 40, 42, respectively, via swivel arms 44. This clamps the product 12. In this phase, such clamping is especially effected between auxiliary transport bands 26 of small format means 60 and supporting means 40, 42. Front trimming is subsequently effected via upper punching knife 52.

The upper punching knife 52 and the hold-down means 54 are then moved upwardly and stops 50 are pivoted away downwardly. Transport bands 18, 20, 26 are then put into operation, whereupon the respective product 12, supported by small format means 60, is transported in the direction of arrow F into a subsequent position for foot and head trimming without any warping and in good registry. Before these cuts are realized, the bands are again stopped. Subsequently, swivel arms 44 as well as stops 50, 50' are again pivoted upwardly whereupon the next product 12 can be inserted and a new clock cycle begins.

Yet another embodiment is described in connection with FIGS. 5 and 6. That embodiment is similar to that illustrated in FIGS. 3 and 4 except that a new link 118 extends between an auxiliary deflector role 28' and a second small roll 120 which is vertically adjustable by means about to be described (rather than the vertically adjustable roll 28 of FIG. 3).

Figure 5:
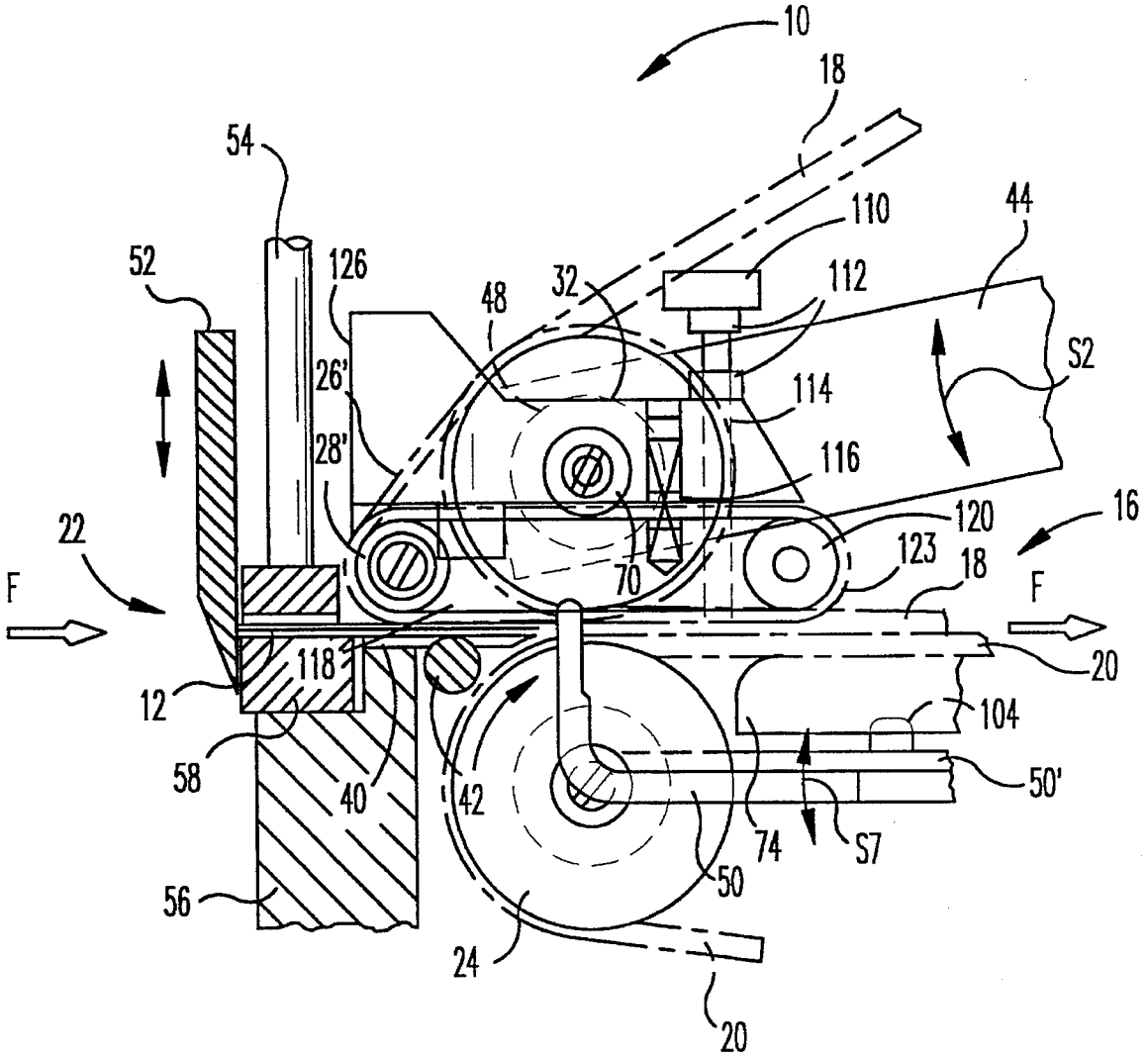
FIG. 5 is a schematic sectional view of another alternative apparatus taken along I—I of FIG. 6.
Figure 6:
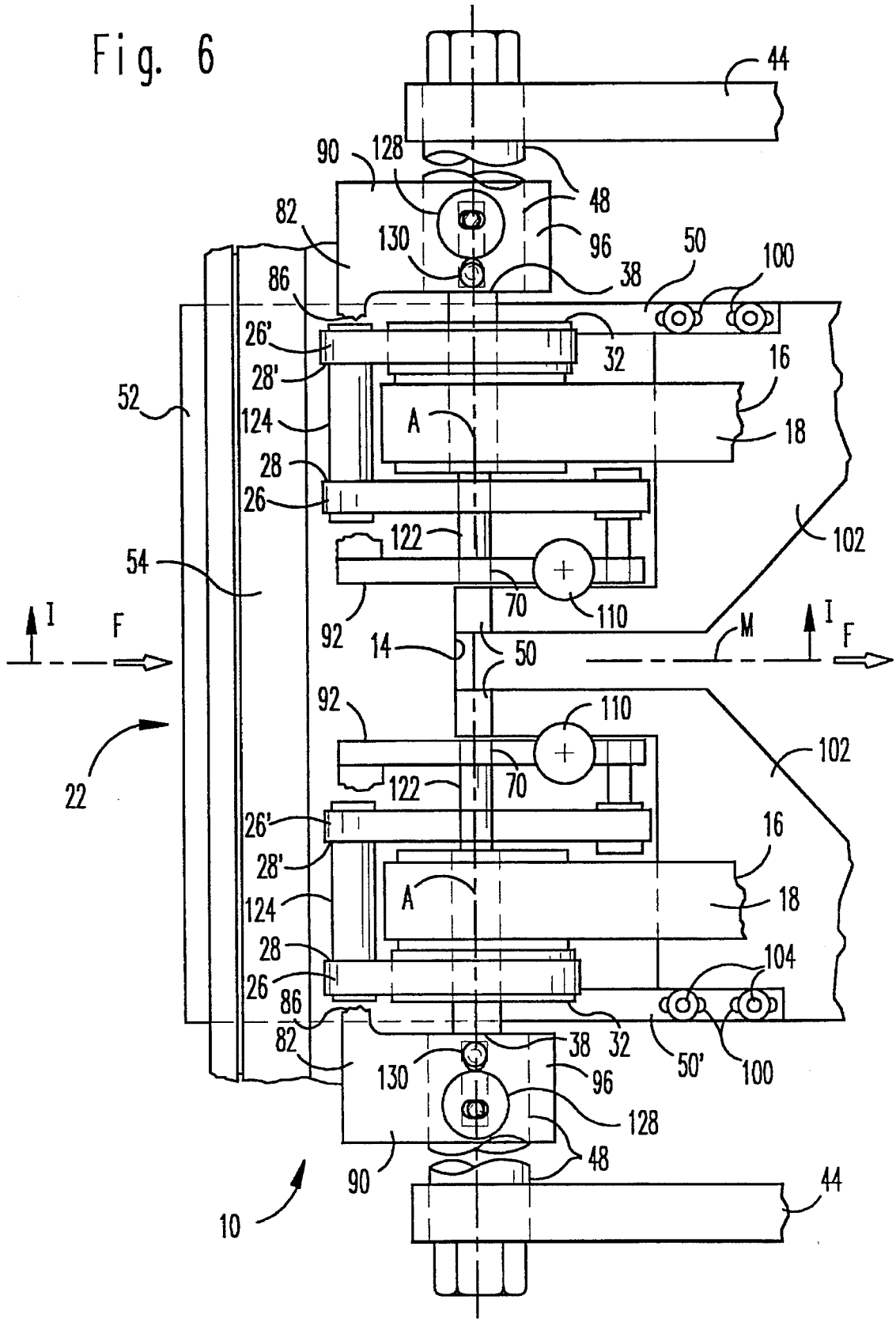
FIG. 6 is a schematic plan view of the cutting apparatus of FIG. 5.

In FIGS. 5 and 6, an adjusting means 108 is comprised of a knurled knob 110 adjacent to nuts 112 located on a threaded spindle 114 which, when rotated by the knob 110, moves the link 118 and the small roller 120 upwardly and downwardly against the force of a compression spring 116 located between the link 118 and a support block 126. The motion of the small roll 120 is pivotable about a pivot pin 122; and, it is the motion of the roller 120 which provides the primary adjustment for the various thicknesses of booklets 12 that are fed to and through the cutting apparatus of FIGS. 5 and 6.

A padded transport belt 123, similar to padded belt 26 in the FIG. 3 embodiment, passes around the two small rolls 28' and 120.

The belt 26 remains in the FIG. 5 and 6 embodiment, but it need not be padded. The belt 26 is the drive roller for the padded belt 123; and, a timing pulley 124 is provided to synchronously drive all of the belts.

The left auxiliary roll 28' in FIG. 5 is essentially fixed except for a rough adjustment which pivots about shaft 48 in FIG. 6. The rough adjustment includes a kipp handle 128 to lock the position of the entire assembly. An eccentric 130 is also included to provide a fine adjustment of the position of the entire assembly about shaft 48.

The new roller 120 now has the basic adjusting mechanism and spring; and it also has the padded belt 123 which extends between the auxiliary deflection roll 28' and the new roll 120.

The FIG. 5 and 6 embodiment illustrates only a single adjusting knob 110 for the padded belt 123, but it will be understood by those skilled in the art that additional belts such as 123 can be employed and that correspondingly additional adjusting means 108 can also be employed.

Due to the configuration in accordance with the invention, booklet base lengths in the range of 6.5 cm can be achieved instead of the hitherto smallest possible base length of about 8.9 cm.

There may basically be provided both a pair of transport bands and a plurality of such pairs of transport bands. Corresponding multi-up is ensured according to the number of pairs of transport bands.

The apparatus according to the invention may basically be employed not only in a gather-stitcher system, but also in other aggregates such as book manufacturing, folding or printing machines.

The products to be processed by the apparatus in accordance with the invention may be stitched in most various manners, inclusive of not only clamped or, respectively, wire-stitched and thread-stitched products, but also glued, sized and lumbecked products.

What is claimed is:

1. Apparatus for transporting a product bound in a booklet-like manner so that a bound-spine end may be inserted into a cutting mechanism and be transported therethrough, said apparatus comprising:

a transport means for transporting said product between a first position serving for front trimming and a second position serving for foot-and-head trimming, the transport means including at least one pair of main transport bands guided about a main deflection roll located adjacent said cutting mechanism; and, at least one synchronously drivable auxiliary-transport band guided about an auxiliary drive that is connected to said main deflection roll about an auxiliary deflection roll that is located closer to said cutting mechanism than said main deflection roll, the diameter of said auxiliary deflection roll being less than the diameter of said main deflection roll.

2. Apparatus according to claim 1, characterized in that there is provided at least one stop which is movable into the transport path of the respective product and adjustable in the direction of transport and on which said spine of the product abuts when said product occupies its position serving for front trimming.

3. Apparatus according to claim 2, characterized in that the stop has associated therewith a further stop that is adjustable relative to said stop.

4. Apparatus according to claim 2, characterized in that there are provided at least four stops distributed transversely with respect to the direction of transport and combined in pairs, respectively one stop of a respective pair of stops being adjustable relative to the other one.

5. Apparatus according to claim 4, characterized in that two adjacent inner stops respectively have associated therewith an outer stop being adjustable relative to the inner stop.

6. Apparatus according to claim 1, characterized in that there are provided two pairs of transport bands comprising a spacing from each other and having in their turn at least one auxiliary transport band associated therewith.

7. Apparatus according to claim 1, characterized in that said auxiliary transport band extends between and about said auxiliary deflection roll and a second auxiliary roll; and, wherein said second auxiliary roll is adjustable upwardly and downwardly to accommodate products of different thicknesses.

8. Apparatus according to claim 7, wherein said auxiliary deflection roll and said second auxiliary roll are joined by a link.

9. The apparatus of claim 8, wherein said link is pivotable about a pivot pin and wherein the upward and downward adjustment is obtained by a screw-thread assembly acting against a bias force.

10. The apparatus of claim 9, wherein said apparatus includes a support block and said bias force is provided by a spring located between said link and said support block.

11. Apparatus of claim 7, including a separate drive belt for driving said auxiliary transport band.

12. Apparatus of claim 7, characterized in that said auxiliary deflection roll and said second auxiliary roll are connected to a pivotable arm, the swivel axis of which is parallel with said auxiliary rotational axis of the deflection roll extending through a spindle portion of said apparatus and including a lockable kipp member for locking the position of said pivotable arm relative to said spindle portion.

13. The apparatus of claim 12, including an eccentric for further adjusting the position of said pivotable arm relative to said spindle portion.

14. The apparatus of claim 1, wherein said auxiliary transport band is padded.

15. Apparatus according to claim 1 characterized in that said auxiliary deflection roll is less than half the diameter of said main deflection roll.

16. Apparatus according to claim 1 characterized in that the diameter of said auxiliary deflection roll is less than one third the diameter of said main deflection roll.

17. Apparatus according to claim 1 including two of said auxiliary transport bands, one said auxiliary transport band being located on each side of said main deflection roll.

18. Apparatus according to claim 17 wherein said auxiliary drive is a roll having a rotational axis that is parallel to the axis of rotation of said main deflection roll.

19. Apparatus according to claim 18 wherein said drive roll for said auxiliary transport bands is affixed to said main deflection roll and has the same diameter as said main deflection roll.

20. Apparatus according to claim 18 characterized in that said drive roll for said auxiliary transport bands is affixed to said main deflection roll by pins that are parallel to the axis of rotation of said main deflection roll.

21. Apparatus according to claim 1 including a supporting means for supporting said product adjacent said auxiliary deflection roll.

22. Apparatus according to claim 21 wherein said supporting means includes at least one support roll.

23. Apparatus according to claim 1 including a pivotable arm having a pivot-axis that is parallel to said axis of rotation of said main deflection roll, and wherein said auxiliary deflection roll is mounted on said pivotable arm.

24. Apparatus of claim 23 wherein said pivot axis of said pivotable arm is coaxial with the axis of rotation of said main deflection roll.

25. Apparatus according to claim 23 including a supporting means for supporting said product, and wherein said pivotable arm includes an adjustment for adjusting the space between said supporting means and said auxiliary deflection roll.

26. Apparatus according to claim 25 including a pair of said pivotable arms and a stop for each of said pivotable arms and wherein each of said pivotable arms is pivotable independently of the other and adjustable relative to said auxiliary deflection roll independently of the other.

27. Apparatus according to claim 23 including a pair of said pivotable arms, a pair of said auxiliary deflection rolls, and a pivotable frame upon which said pair of pivotable arms is mounted, the pivot axis of said pivotable frame being parallel to the axis of said main deflection roll.

28. Apparatus of claim 27 wherein said pivot axis of said pivotable frame is coaxial with said axis of said main deflection roll.

29. Apparatus according to claim 27 characterized in that said auxiliary deflection rolls are rotatable about a common rotational axis.

30. Apparatus according to claim 29 characterized in that said pivotable frame is U-shaped and wherein said pivotable arms are comprised of legs of the U-shaped frame; and, in that said common-rotational axis is comprised of a shaft extending between the legs of said frame.

31. Apparatus according to claim 27, including a stop and characterized in that said pivotable arms are supported on said stop which is provided on a portion carrying said pivotable arms and via which the spacing between the deflection rolls of the auxiliary transport bands mounted on said pivotable arms and the opposite supporting means may be adjusted.

32. Apparatus according to claim 25 wherein said pivotable arm is rotatable about the axis of rotation of said auxiliary drive roll and said axis of rotation is common to the axis of said main-deflection roll.

* * * * *